US005701850A

United States Patent [19]

Köhler et al.

[11] Patent Number: 5,701,850

[45] Date of Patent: Dec. 30, 1997

[54] STEAM GENERATOR

[75] Inventors: Wolfgang Köhler, Kalchreuth; Rudolf Kral, Forchheim; Eberhard Wittchow, Erlangen, all of Germany

[73] Assignee: Siemens Aktiengesellschaft, Munich, Germany

[21] Appl. No.: 390,987

[22] Filed: Feb. 21, 1995

Related U.S. Application Data

[63] Continuation of PCT/DE93/00698, Aug. 6, 1993.

[30] Foreign Application Priority Data

Aug. 19, 1992 [DE] Germany ..... 42 27 457.5

[51] Int. Cl.[6] ..... F22B 15/00; F22B 25/00; F22B 37/10

[52] U.S. Cl. ..... 122/235.23; 122/235.11; 122/235.12; 122/130; 122/406.4

[58] Field of Search ..... 122/235.11, 235.12, 122/235.14, 235.15, 235.23, 406.1, 406.14, 130

[56] References Cited

U.S. PATENT DOCUMENTS

| | | | |
|---|---|---|---|
| 475,479 | 5/1892 | Abel | 122/130 |
| 3,221,713 | 12/1965 | Wiener | 122/406.4 |
| 3,556,059 | 1/1971 | Friedrich | 122/406 |
| 4,075,979 | 2/1978 | Michel | 122/235.12 |
| 4,178,881 | 12/1979 | Pratt et al. | 122/235.12 |
| 4,191,133 | 3/1980 | Stevens | 122/235.11 |
| 5,347,955 | 9/1994 | Wittchow | 122/235.23 |
| 5,390,631 | 2/1995 | Albrecht | 122/235.23 |

FOREIGN PATENT DOCUMENTS 574810 1/1946 United Kingdom .

*Primary Examiner*—Henry A. Bennett
*Assistant Examiner*—Jiping Lu
*Attorney, Agent, or Firm*—Herbert L. Lerner; Laurence A. Greenberg

[57] ABSTRACT

A fossil-fired steam generator includes a gas flue having a surrounding wall being formed by tubes which are mutually joined gas-tightly and which are disposed substantially vertically and can conduct an upward flow through them on the medium side. The tubes in a first or lower part of the gas flue have a greater internal diameter than the tubes in a second part of the gas flue located above. On one hand, this ensures reliable cooling of the tubes. On the other hand, even additional or above-average heating of individual tubes does not lead to inadmissible temperature differences between outlets of the tubes.

11 Claims, 2 Drawing Sheets

STEAM GENERATOR

CROSS-REFERENCE TO RELATED APPLICATION

This application is a Continuation of International Application Ser. No. PCT/DE93/00698, filed Aug. 6, 1993.

BACKGROUND OF THE INVENTION

1. Field of the Invention

The invention relates to a fossil-fired steam generator with a gas flue having a surrounding wall that is formed by tubes which are mutually joined gas-tightly and which are disposed substantially vertically and can conduct a parallel upward flow therethrough on the medium side.

The surrounding wall is frequently exposed to different intensities of heating from heating-surface element to heating-surface element. Thus, in most cases, the heating is substantially more intense in the lower part, in which a number of burners for the fossil fuel is disposed, than in the upper part. A further reason therefor is that frequently additional heat exchanger surfaces which are disposed in the upper part screen the surrounding wall from unduly intensive heating, especially from radiant heat.

In a steam generator known from European Patent No. 0 054 601 B1, the surrounding wall of the vertical gas flow only serves as a vaporizer heating surface in the lower part. The steam, or the water/steam mixture in the case of a partial load, is then passed to a downstream convection vaporizer. The upper part of the surrounding wall is formed by tubes serving as superheating surface. Since only a part of the surrounding wall is utilized as a vaporizer surface, only relatively small temperature differences occur at the outlet of those tubes in the case of additional heating or above-average heating of individual tubes. A non-uniform distribution of the water/steam mixture over the tubes of the convection vaporizer downstream of the vaporizer heating surface can be controlled because of the limited heating of that vaporizer. However, since the cooling of the upper part of the surrounding wall is effected by superheated steam under a high pressure of about 280 to 320 bar, steel with a high chromium content, which requires complicated heat treatment during manufacture, is used in that upper part of the surrounding wall. In addition, due to required connecting lines and headers leading to and from the convection vaporizer, that known circuit is very expensive and requires an increased control effort in the convection flue, especially due to the installation of control flues on the flue gas side. Similar equipment is also described in the printed publication VGB Kraftwerkstechnik, Issue No. 7, 1991, pages 637 to 643.

In a continuous-flow steam generator with a spiral tube configuration of the surrounding wall, in which the mass flow density in tubes is usually about 2500 kg/m$^2$s, the effect of additional heating upon temperature differences between the tubes can be reduced by increasing the internal tube diameter in the upper part of the vertical gas flue. However, in order to surround walls with vertically disposed tubes that principle cannot be applied, since the mass flow density, which is a measure of the flow velocity in the tubes and which is comparatively small anyway, is then reduced to such an extent that reliable cooling of the tubes is no longer ensured at steam pressures in the vicinity of the critical point. A further serious point is that, on one hand, high mass flows are necessary for reliable cooling of the tubes and, on the other hand, high mass flows can lead to large temperature differences between individual tubes. Furthermore, if a reheat header is used in the wet steam zone, there is a risk of uneven distribution of water and steam due to segregation, so that large temperature differences can arise in the tube system downstream of the reheat header.

SUMMARY OF THE INVENTION

It is accordingly an object of the invention to provide a steam generator, which overcomes the hereinaforementioned disadvantages of the heretofore-known devices of this general type in such a way that, on one hand, adequate cooling of the tubes of the surrounding wall is ensured and, on the other hand, even additional heating of individual tubes does not lead to inadmissible temperature differences between the individual tubes. This object is to be achieved at low cost.

With the foregoing and other objects in view there is provided, in accordance with the invention, a fossil-fired steam generator, comprising a gas flue having a bottom, a first part disposed at the bottom, a second part disposed above the first part, and a surrounding wall; the surrounding wall being formed of substantially vertical, mutually gas-tightly connected tubes for conducting an upward flow of a medium; and the tubes in the first part of the gas flue having a greater internal diameter than the tubes in the second part of the gas flue.

The first part of the gas flue which is located at the bottom and which is also referred to below as the first section of the surrounding wall, is distinguished by very high heat flux densities and good internal heat transfer into the tubes and is located, for example, in a burner zone. The second part of the gas flue, which is located above the first part and which is also referred to below as the second section of the surrounding wall, is also distinguished by high heat flux densities, but it has poorer internal heat transfer into the tubes and is located, for example, in a so-called gas-radiant space of the steam generator, which adjoins the burner zone.

In accordance with another feature of the invention, in order to improve the internal heat transfer, the first section of the surrounding wall includes internally finned, vertically disposed tubes. These preferably have such dimensions that the mean mass flow density in the tubes is preferably less than 1000 kg/m$^2$s at full load. At the outlet of the first section, the steam has a mean steam content which, at about 40% partial load, is between 0.8 and 0.95. Under these conditions, such favorable flow conditions are established that additional heating of individual tubes leads to an increased throughput through these tubes, so that only small temperature differences arise at the outlet of the tubes.

In the second section of the surrounding wall, a heat transfer crisis, i.e. a so-called dry-out, can arise depending on the operating state. In order to avoid inadmissibly high tube wall temperatures in the case of this poorer internal heat transfer, the mass flow density is preferably increased to more than 1000 kg/m$^2$s. For this reason, the internal diameter of the tubes is reduced at the transition from the first to the second section, while retaining the same number of parallel tubes or tube pitches. The reduction of the internal diameters ensures reliable tube cooling even at a high heat flux density in the second section.

In accordance with a further feature of the invention, the tubes of the smaller internal diameter in the second section are directly joined to the tubes of the larger internal diameter in the first section, so that the tubes of the two sections directly merge. The tubes of the second section can also have internal finning, at least in the part initially conducting the flow.

In a heated parallel vaporizer tube system, a pressure drop arises between the inlet and the outlet. That pressure drop is generated towards the outlet essentially by friction due to high steam velocities. A high frictional pressure drop has the effect of causing the mass flow through more intensely heated tubes to either be reduced or rise less steeply as compared with the heating. If a pressure balance vessel is then disposed in a region in which the frictional pressure drop rises sharply due to steam formation, the system located upstream of the pressure balance vessel can almost ideally adapt itself to the differences in heating. In other words, more intense heating yields a mass flow which is approximately equally more intense.

In accordance with an added feature of the invention, there is provided a pressure balance tube connected to each tube in the upper half of the first part of the gas flue, for example in the vicinity of a transition from the first to the second section.

In accordance with an additional feature of the invention, the pressure balance tubes lead to one or more pressure balance vessels provided outside the vertical gas flue. Due to the pressure balance, the two sections are largely uncoupled on the flow side. The relatively high frictional pressure drop in the second section because of the comparatively large mass flow density therefore has no effect on the favorable flow conditions in the first section. Thus, uneven temperature conditions (temperature gradient across the tube cross-section) due to additional heating at the outlet of the first section cannot occur. Due to the direct transition from the tubes of the first section to the tubes of the second section, a water/steam segregation in the wet-steam region is reliably avoided.

In accordance with yet another feature of the invention, in a steam generator with a high gas flue, for example a steam generator with a single-flue construction, the tubes have a larger internal diameter in a third, upper part of the gas flue, than in the second part of the gas flue which is located under the third part. This third part of the gas flue, which is also referred to below as a third section of the surrounding wall, is distinguished by a low heat flux density and a moderate internal heat transfer in the tubes and is within the so-called convection flue of the steam generator.

At the transition from the second to the third section of the surrounding wall, the mass flow density falls again, because of the low heat flux density prevailing there, as compared with that in the second section, in order to keep a low frictional pressure drop in the tubes. In the third section, the tubes can be formed without internal finning.

In accordance with a concomitant feature of the invention, in the further course of the vertical gas flue, the heat flux density decreases to such an extent that in the third part of the gas flue, that is to say in the third section of the surrounding wall, half the number of tubes as in the second part of the gas flue, that is to say in the second section of the surrounding wall, is sufficient. The halving of the number of tubes in the third section is achieved by two tubes of the second part of the gas flue each leading in common into one respective tube of the third part of the gas flue.

Other features which are considered as characteristic for the invention are set forth in the appended claims.

Although the invention is illustrated and described herein as embodied in a steam generator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
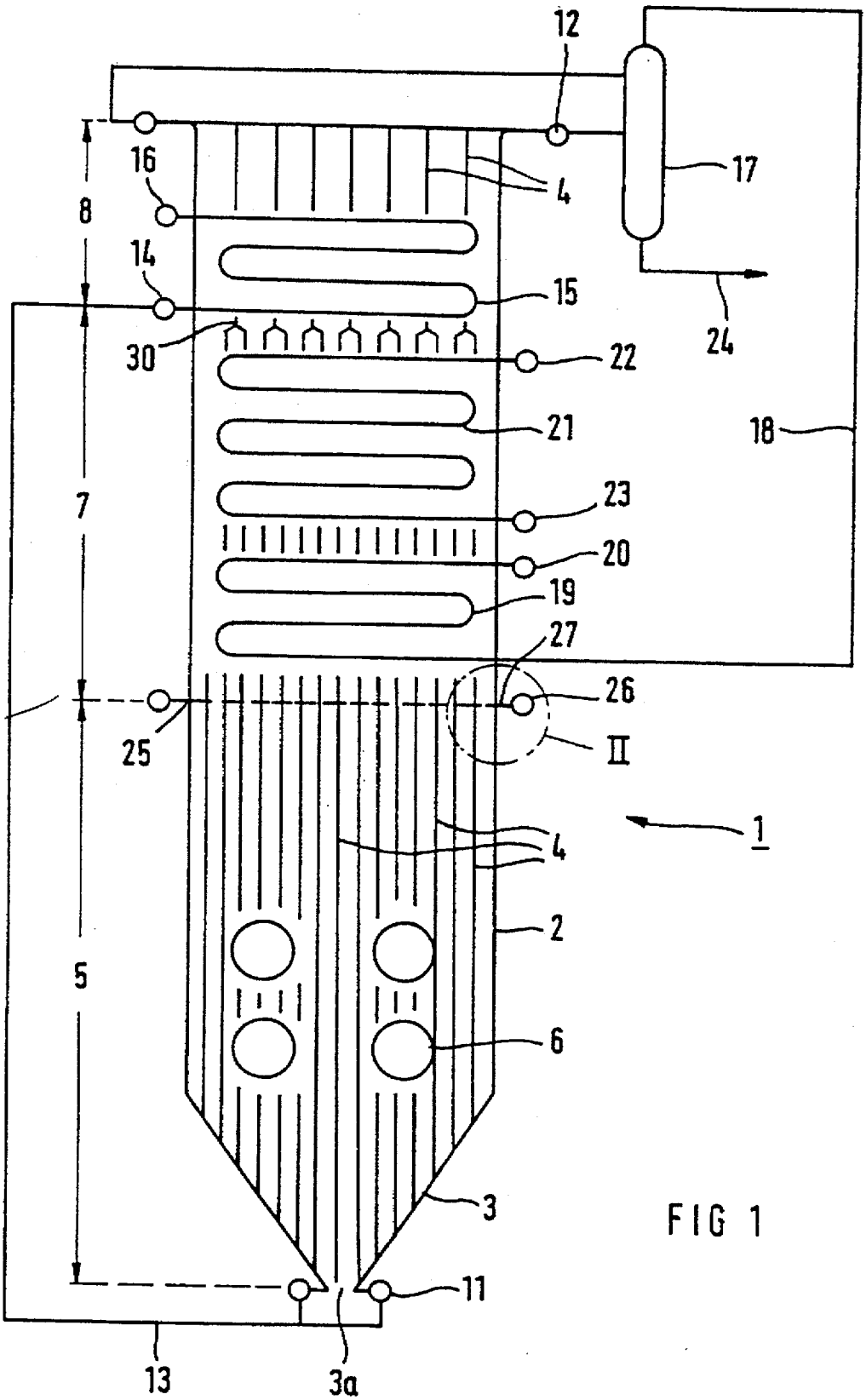
FIG. 1 is a diagrammatic, longitudinal-sectional view of a steam generator with a gas flue divided into three sections.

Referring now in detail to the figures of the drawing, in which mutually corresponding parts are provided with the same reference numerals, and first, particularly, to FIG. 1 thereof, there is seen a vertical gas flue of a steam generator 1 of rectangular cross section which is formed by a surrounding wall 2 that merges into a funnel-shaped bottom 3 at a lower end of the gas flue. Tubes 4 of the surrounding wall 2 are mutually joined gas-tightly, for example by welding, at their longitudinal sides, such as through fins 9 shown in FIG. 2. The bottom 3 contains a discharge port 3*a* for non-illustrated ash.

In a lower or first part 5 of the gas flue, that is to say in a first section of the surrounding wall 2, as an example four burners for a fossil fuel are each fitted in a port 6 in the surrounding wall 2. At such a port 6, the tubes 4 of the surrounding wall 2 are curved and they run on the outside of the vertical gas flue. Similar ports can also be formed, for example, for air nozzles or flue gas nozzles.

A second part 7 of the gas flue, that is to say a second section of the surrounding wall 2, is disposed above the first, lower part 5 of the gas flue. A third or upper part 8 of the gas flue, that is to say a third section of the surrounding wall 2, is provided above the second part 7 of the gas flue.

The first section 5 which is in a burner zone is distinguished by a very high heat flux density and good internal heat transfer in the tubes 4. The second section 7 is located in a gas-radiant space and is likewise distinguished by a high heat flux density, but also by a lower poorer internal heat transfer in the tubes 4. The third section 8 is located in a convection flue and is distinguished by a low heat flux density and a moderate internal heat transfer into the tubes 4. This third section 8 is preferably present in a steam generator in single-flue construction.

Assuming a parallel upward flow of a medium, that is to say a flow of water or a water/steam mixture, the tubes 4 of the surrounding wall 2 are connected at their inlet ends to an inlet header 11 and at their outlet ends to an outlet header 12. The inlet header 11 and the outlet header 12 are located outside the gas flue and are, for example, each formed by an annular pipe.

The inlet header 11 is connected through a line 13 and a header 14 to an outlet of a high-pressure preheater or economizer 15. A heating surface of the economizer 15 is located in a space surrounded by the third section 8 of the surrounding wall 2. During operation of the steam generator 1, the economizer 15 is connected on the inlet side through a header 16 to a water-steam circuit of a steam turbine.

The outlet header 12 is connected through a water/steam separation vessel 17 and a line 18 to a high-pressure superheater 19. The high-pressure superheater 19 is located in the region of the second section 7 of the surrounding wall 2. During operation, the high-pressure superheater 19 is connected on the outlet side through a header 20 to a high-pressure part of the steam turbine. In the region of the second section 7, there is moreover a resuperheater 21 which is connected through headers 22, 23 to a point between the high-pressure part and a medium-pressure part of the steam turbine. Water being developed or arising in the water-steam separation vessel 17 is discharged through a line 24.

In a region 25 of a transition from the first section 5 to the second section 7 of the surrounding wall 2, a pressure balance vessel 26 formed by an annular pipe is provided outside the gas flue.

Figure 2:
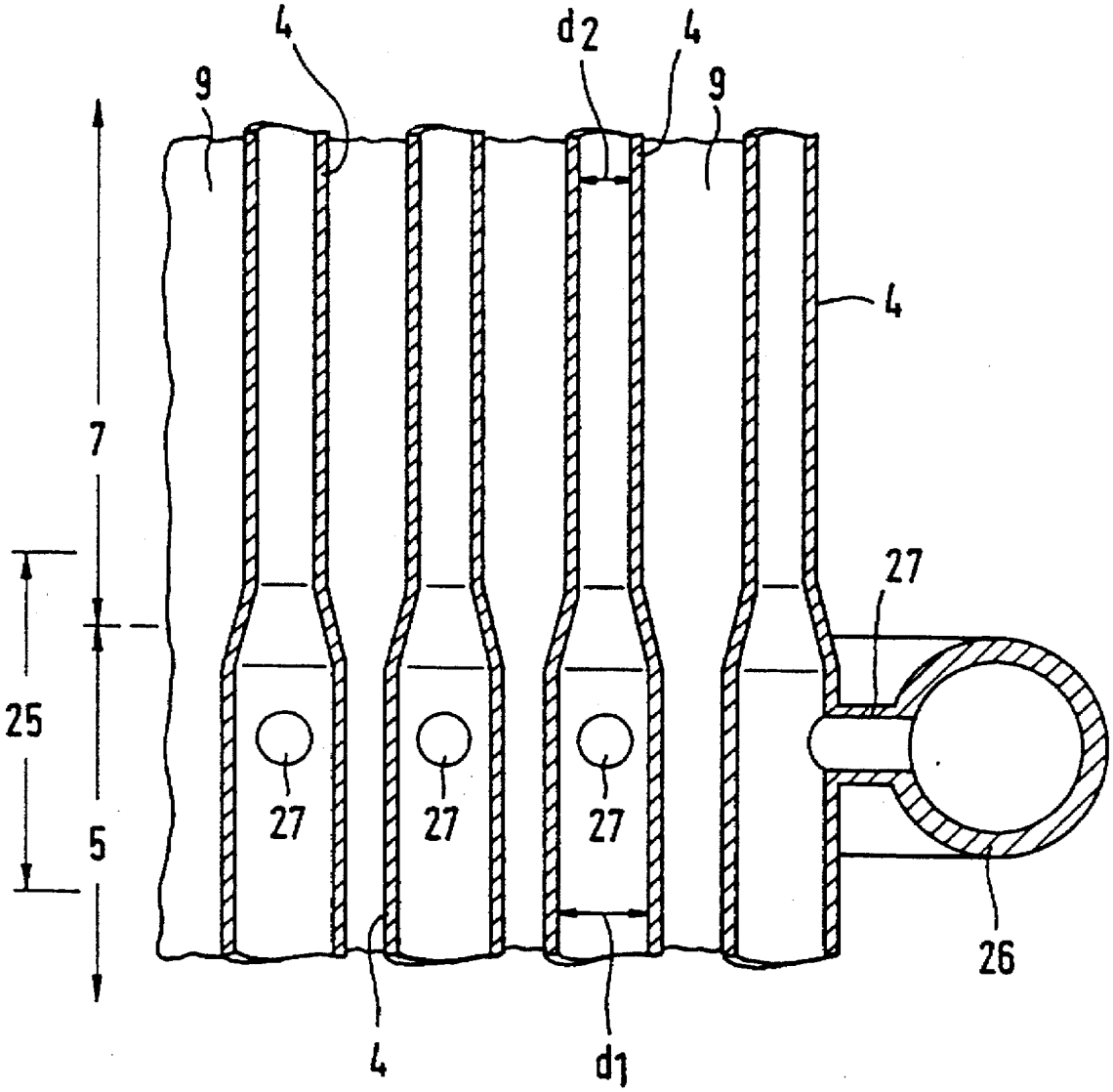
FIG. 2 is an enlarged, fragmentary view of a portion II of FIG. 1, with tubes having different internal diameters in various sections.

As can be seen from FIG. 2, each tube 4 running in the sections 5 and 7 is connected through a pressure balance tube 27 to the pressure balance vessel 26.

In the region 25, in which the tubes 4 merge from the first section 5 into the second section 7, the clear or open width of the tubes 4 narrows. In other words, the tubes 4 have an internal diameter $d_1$ in the lower part 5 of the gas flue which is greater than an internal diameter $d_2$ of the tubes 4 in the second part 7 of the gas flue that is located above. In this case, the tubes 4 with the smaller internal diameter $d_2$ are joined directly to the tubes 4 with the larger internal diameter $d_1$. In other words, the tubes 4 merge into one another in the region 25. In the section 5, the tubes 4 have a non-illustrated thread-like internal finning. In the section 5, the tubes 4 are of such dimensions that the mean mass flow density there at full load is less than or equal to 1000 $kg/m^2s$. The mean mass flow density of the tubes 4 is then greater than 1000 $kg/m^2s$ in the second or middle section 7.

In the third or upper section 8 of the surrounding wall 2, the tubes 4 again have a greater internal diameter than those in the section 7 located below. While the tubes 4 also have a thread-like internal finning in the second section 7, preferably over their entire length, the tubes 4 of the third section 8 are provided with the thread-like internal firming over only a part of their length. Preferably, however, internal finning is omitted.

The number of tubes 4 in the upper section 8 of the surrounding wall 2 is only half that in the second section 7. Therefore, with reference to FIG. 1, in a region 30 two tubes 4 of the second section 7 in each case lead into a tube 4 which is associated with them in common in the third section.

As is shown in FIG. 2, the external diameter of the tubes 4 is also different in the sections 5 and 7 and is adapted to the particular internal diameter $d_1$, $d_2$ in such a way that the wall thickness of the tubes 4 is approximately the same in all sections 5, 7 and 8. However, it is also possible for the external diameter of the tubes 4 to be the same in all sections 5, 7, and 8, so that the wall thickness of the tubes 4 in the middle or second section 7 is greater than in the first section 5 and/or in the third section 8. As was already mentioned, the tubes 4 are provided on their longitudinal sides with fins 9 which serve for gas-tight joining of the tubes 4.

As a result of the fact that the tubes 4 of the surrounding wall 2 have different internal diameters $d_1$, $d_2$ along their length in the various sections 5, 7, 8 or regions of the steam generator 1, the dimensioning of the tubes 4 of the surrounding wall 2 is matched to different heating of the gas flue. On one hand, this ensures reliable cooling of the tubes 4. On the other hand, additional heating of individual tubes 4 also does not lead to inadmissible temperature differences between the outlets of the individual tubes 4.

We claim:

1. A fossil-fired steam generator, comprising:

a gas flue having a bottom and a surrounding wall;

said surrounding wall having a first part disposed at said bottom of said gas flue and a second part disposed above said first part;

said surrounding wall being formed of substantially vertical, mutually gas-tightly connected tubes for conducting a flow of a medium;

said tubes in said first part of said surrounding wall having a greater internal diameter than said tubes in said second part of said surrounding wall;

a pressure balance vessel disposed outside said gas flue; and pressure balance tubes each connecting a respective one of said tubes of said surrounding wall to said pressure balance vessel.

2. The steam generator according to claim 1, wherein said tubes having a smaller internal diameter are joined directly to said tubes having a larger internal diameter.

3. The steam generator according to claim 1, wherein said tubes having a smaller internal diameter merge into said tubes having a larger internal diameter.

4. The steam generator according to claim 1, wherein said tubes in said first part of said surrounding wall have a mean mass flow density being at most 1000 $kg/m^2s$ at full load.

5. The steam generator according to claim 1, wherein said surrounding wall has a top and a third part disposed at said top, and said tubes of said surrounding wall disposed in said third part have a greater internal diameter than said tubes of said second part and are joined directly to said tubes in said second part.

6. The steam generator according to claim 5, wherein said third part of said surrounding wall has half the number of said tubes as in said second part of said surrounding wall, and each two of said tubes in said second part lead in common into a respective one of said tubes in said third part.

7. The steam generator according to claim 1, wherein said surrounding wall has a top and a third part disposed at said top, and said tubes of said surrounding wall disposed in said third part have a greater internal diameter than said tubes of said second part and merge into said tubes in said second part.

8. The steam generator according to claim 7, wherein said third part of said surrounding wall has half the number of said tubes as in said second part of said surrounding wall, and each two of said tubes in said second part lead in common into a respective one of said tubes in said third part.

9. The steam generator according to claim 1, wherein said first part of said surrounding wall has an upper half, and each of said pressure balance tubes is located in said upper half of said first part.

10. The steam generator according to claim 1, wherein said first part of said surrounding wall has an upper third, and each of said pressure balance tubes is located in said upper third of said first part.

11. The steam generator according to claim 1, including a transition region from said first part to said second part of said surrounding wall, each of said pressure balance tubes being located in said transition region.

* * * * *